US009371702B2

(12) United States Patent
Anker et al.

(10) Patent No.: US 9,371,702 B2
(45) Date of Patent: Jun. 21, 2016

(54) WELL TUBINGS WITH POLYMER LINERS

(75) Inventors: Martin Anker, Hisings Kärra (SE); Siegfried Liedauer, Wilhering (AT); Markus Oberndorfer, Vienna (AT); Karin Thayer, Mautern (AT)

(73) Assignee: Borealis AG, Vienna (AT)

( * ) Notice: Subject to any disclaimer, the term of this patent is extended or adjusted under 35 U.S.C. 154(b) by 1325 days.

(21) Appl. No.: 12/735,163

(22) PCT Filed: Dec. 12, 2008

(86) PCT No.: PCT/EP2008/067400

§ 371 (c)(1), (2), (4) Date: Sep. 27, 2010

(87) PCT Pub. No.: WO2009/080556

PCT Pub. Date: Jul. 2, 2009

(65) Prior Publication Data

US 2011/0011482 A1 Jan. 20, 2011

(30) Foreign Application Priority Data

Dec. 20, 2007 (EP) ..... 07123834

(51) Int. Cl.

| | |
|---|---|
| ***F16L 9/14*** | (2006.01) |
| ***E21B 17/00*** | (2006.01) |
| ***E21B 17/10*** | (2006.01) |

(52) U.S. Cl.

CPC ..... *E21B 17/003* (2013.01); *E21B 17/1007* (2013.01)

(58) Field of Classification Search

CPC ..... E21B 17/003; E21B 17/1007

USPC ..... 138/140, 141, 145; 166/242.1–242.4, 166/242.6; 29/458, 527.2; 428/35.7–36.92

See application file for complete search history.

(56) References Cited

U.S. PATENT DOCUMENTS 3,429,954 A * 2/1969 Atkins et al. ..... 264/456
3,956,212 A * 5/1976 Sakaguchi et al. ..... 524/399

(Continued)

FOREIGN PATENT DOCUMENTS

GB 2 272 038 A 5/1994
GB 2 335 251 A 9/1999

(Continued)

OTHER PUBLICATIONS

Tamboli et al., Crosslinked Polyethylene, Nov. 2004, Indian Journal of Chemical Technology, vol. 11, p. 853-864. Accessed via <http://nopr.niscair.res.in/bitstream/123456789/9558/1/IJCT%2011(6)%20853-864.pdf>.*

(Continued)

*Primary Examiner* — Patrick F Brinson
*Assistant Examiner* — Matthew Lembo
(74) *Attorney, Agent, or Firm* — Warn Partners, P.C.

(57) ABSTRACT

The invention relates to well tubings, in particular oil well tubings, having an improved resistance to abrasion and corrosion. A well tubing comprises a plurality of tubing sections each having a bore and an inside diameter, wherein at least part of the tubing sections has polymer liners disposed within said bore of said tubing section, characterized in that said polymer liners are comprised of crosslinked polyethylene.

15 Claims, 1 Drawing Sheet

(56) References Cited

U.S. PATENT DOCUMENTS

| | | | | |
|---|---|---|---|---|
| 4,512,791 | A | 4/1985 | Kyle | |
| 4,823,456 | A | 4/1989 | Gray | |
| 4,938,285 | A * | 7/1990 | Edwards et al. | 166/241.4 |
| 5,334,268 | A * | 8/1994 | Hermanson et al. | 148/530 |
| 5,511,619 | A | 4/1996 | Jackson | |
| 5,756,023 | A | 5/1998 | Stachowiak | |
| 5,792,532 | A * | 8/1998 | Pfleger | F16L 11/118 138/121 |
| 5,879,743 | A * | 3/1999 | Revankar | 427/191 |
| 5,918,641 | A * | 7/1999 | Hardy | F16L 11/087 138/132 |
| 6,723,384 | B2 * | 4/2004 | Bianchi et al. | 427/292 |
| 7,086,421 | B2 * | 8/2006 | Backman et al. | 138/137 |
| 7,087,697 | B2 * | 8/2006 | Cornette et al. | 526/352 |
| 7,153,571 | B2 * | 12/2006 | Allermann | 428/391 |
| 2003/0213596 | A1 * | 11/2003 | Davis | 166/369 |
| 2004/0118468 | A1 * | 6/2004 | Mestemacher | 138/137 |
| 2004/0140093 | A1 * | 7/2004 | Vloedman et al. | 166/277 |
| 2004/0219317 | A1 * | 11/2004 | Belcher | 428/35.7 |
| 2005/0221033 | A1 * | 10/2005 | Procida | 428/35.7 |
| 2006/0108110 | A1 | 5/2006 | McKeen | |
| 2006/0124308 | A1 * | 6/2006 | Davis | 166/305.1 |
| 2007/0051510 | A1 * | 3/2007 | Veneruso et al. | 166/244.1 |

FOREIGN PATENT DOCUMENTS

| | | | |
|---|---|---|---|
| JP | 2001009912 | A * | 1/2001 |
| UA | 21 827 | U | 4/2007 |
| WO | WO 00/15411 | | 3/2000 |

OTHER PUBLICATIONS

Wang Shanzheng et al., "Application of wear-resistant and anticorrosive tubing with HDPE liners in sucker-rod well pump", Journal of Shengli Oilfield Staff University, Dec. 31, 2006, vol. 20 No. 6.

American Petroleum Institute (API); "Specification for Sucker Rods"; API Specification 11B; Twenty-sixth Edition; Jan. 1, 1998; p. 6, table 7.

* cited by examiner

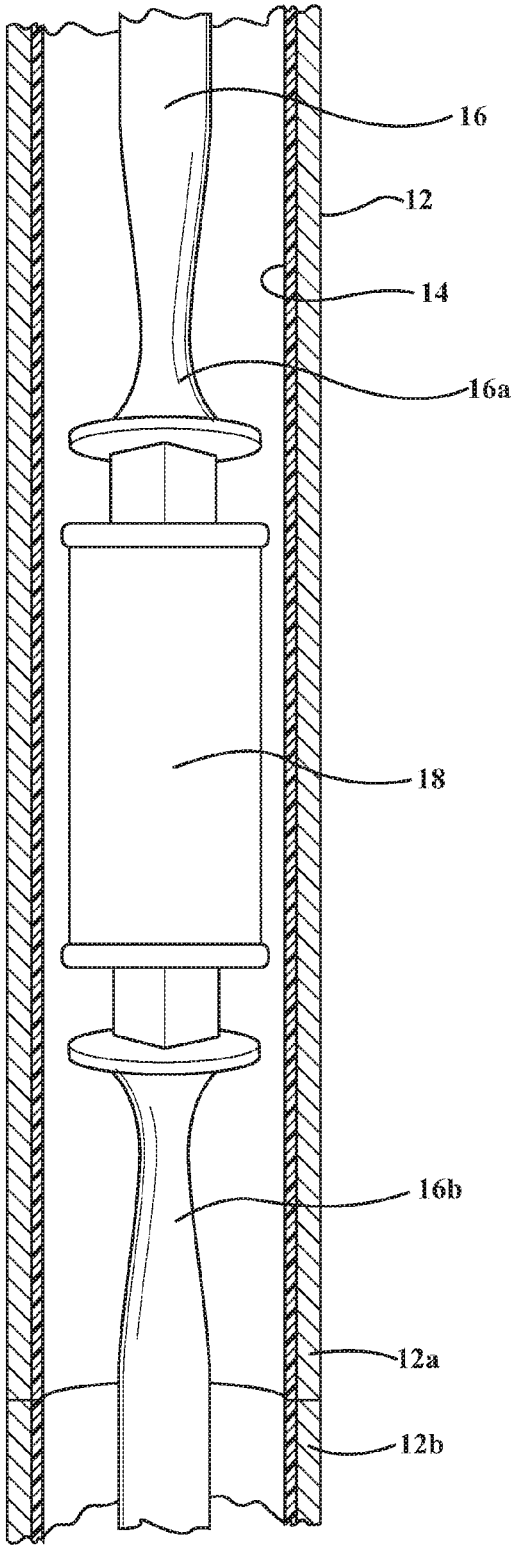
16
12
14
16a
18
16b
12a
12b

WELL TUBINGS WITH POLYMER LINERS

This application is a National Stage of International Application No. PCT/EP2008/067400, filed Dec. 12, 2008. This application claims priority to European Patent Application No. 07123834.9 filed on Dec. 20, 2007. The disclosures of the above applications are incorporated herein by reference.

The invention relates to well tubings having an improved resistance to abrasion and corrosion. In particular, the invention relates to oil well tubings comprising a plurality of tubing sections each having a bore and an inside diameter, wherein at least part of the tubing sections has polymer liners disposed within said bore of said tubing section.

This invention relates to tubing strings used in wells, in particular in oil wells, that are being operated by rod pumping, which is the conventional technique for pumping oil from underground reservoirs. At the surface, a motor drives a walking beam which is connected to a polished rod that is in turn connected to a string of sucker rods which extend down the borehole to support the downhole pump. As the motor runs, the walking beam raises and lowers the polished rod and the string of sucker rods which causes the pump to lift the fluid from the reservoir up to the surface.

Historically, wells which are produced with conventional rod pumping units have evidenced problems with tubing and/or rod or rod coupling failures due to the abrasion of the rods and rod couplings on the tubing walls as the rod string reciprocates. These failures may be accelerated by the presence of corrosive elements and/or by the deviation of the well bore in drilling or through subsidence.

The invention further relates to well tubings, in particular oil well tubings, where a further main method for lifting oil from an underground reservoir involves the use of progressive cavity pumps (PCPs). The use of PCPs is the preferred pumping method when the oil contains a certain amount of sand, which is the cause of high abrasion.

Many millions of oil wells are being operated all over the world, the majority of them by one of the above mentioned methods. The occurrence of corrosion and abrasion makes it necessary that the tubing strings are replaced in regular intervals. This results in high maintenance costs and production losses.

In order to reduce the frequency of repair/maintenance intervals, it has been tried to reline tubing sections with a polymer liner. The polymer material must be abrasion resistant and must have a low coefficient of friction. Additionally, the polymer must be resistant to the produced fluids, especially crude oil and oil/water mixtures and contaminants.

The preferred material which has been used in the past for relining of oil well tubings are polyolefins, such as polypropylene and polyethylene. The use of liners comprising polypropylene is for example disclosed in US 2006/0124308 A1.The use of liners comprising polyethylene is disclosed in U.S. Pat. No. 5,511,619.

High density polyethylene, ultra high density polyethylene and ultra-high molecular weight polyethylene have until now been the preferred polyethylene types used for relining It has however been observed, that the abrasion resistance of these materials is generally not satisfactory. A further problem arises in the production of paraffinic oil. If the temperature of the produced oil drops below the wax temperature of the paraffinic fraction, these fractions segregate, which necessitates an intervention. Such interventions can be necessary up to twice per day, resulting in costs and loss of oil production.

OBJECT

It is therefore the object of the present invention to provide oil well tubings having an improved abrasion resistance. Further, the suitability of tubings to produce paraffinic oil shall be improved. Still further, the corrosion resistance of polyolefinic liners shall be at least maintained.

The above object is achieved with an oil well tubing comprising a plurality of tubing sections each having a bore and an inside diameter, wherein at least part of the tubing sections has polymer liners disposed within said bore of said tubing section, characterized in that said polymer liners are comprised of crosslinked polyethylene.

BRIEF DESCRIPTION OF THE DRAWINGS

The present invention will become more fully understood from the detailed description and the accompanying drawing, wherein:

FIG. 1 is a broken-away sectional view of a rod pumping system, according to the present invention.

DETAILED DESCRIPTION OF THE PREFERRED EMBODIMENTS

A well tubing 12, in particular an oil well tubing, according to this invention is understood as known in the technical filed of oil and/or gas extraction. In particular the well tubing 12 according to the present invention is a well tubing as used for the subsurface sucker rod pump. Accordingly the well tubing 12, in particular an oil well tubing, comprises plurality of tubing sections, e.g. as indicated by 12*a*, 12*b*. each having a bore and an inside diameter. The tubing sections are connected to each other in way that the bores of the sections together form a tube, which extends from the surface downwards the well. Further, each tubing section has a polymer liner 14 disposed within its bore.

It has surprisingly been found that polymer liners from crosslinked polyethylene are able to fulfil the above mentioned requirements. Crosslinked polyethylene liners offer an increased durability in connection with abrasive media, e.g. crude oil containing sand, and also against the abrasive action of pumping rods. Together with the increased resistance to abrasion, the protection against corrosion of crosslinked polyethylene is synergistically increased compared to uncrosslinked polyethylene. The increased durability of the liner also increases the lifetime of the tubing material itself. Liners from crosslinked polyethylene also show improved mechanical parameters at elevated temperatures compared to liners from uncrosslinked polyethylene. This makes liners from crosslinked polyethylene suitable for producing crude oil at higher temperatures.

The inventive concept is also applicable to gas wells and water injection wells, a further application is the production of coal bed methane. The inventive concept can be used in all instances, where a fluid is being lifted from underground through tubings and where this fluid contains solid and abrasive particles and is therefore abrasive and/or corrosive.

Due to the insulation effect and a lower surface energy of the polymer tubes paraffinic oils can be produced more easily as segregation is prohibited. However, in the case of an intervention using steam treatment high temperatures will be applied to the tubings; crosslinked polyethylene shows higher temperature resistance compared to standard uncrosslinked polyethylene tubings.

Due to the same effect also the precipitation of asphaltenes is reduced.

Further, scaling problems have been observed which also lead to a number of interventions. Due to the insulation effect and a lower surface energy of the crosslinked polyethylene tubes the segregation of e.g. calcium carbonate is reduced.

A common problem in gas wells is the accumulation of gas hydrates which have to be treated with methanol. By using tubings lined with crosslinked polyethylene the problems could be reduced by the same effect as above.

The use of lined tubings sections also results in a decrease in energy consumption for lifting the crude oil. Electricity savings of up to 20% were observed.

In the present invention, the liners are "tight fitting", i.e. the outer diameter of the liners—when installed—is exactly as large as the inside diameter of the bore.

In the art there exist a number of techniques to install polyethylene liners in pipes. Reference is made to e.g. WO 00/15411, which is incorporated herein by reference. The WO 00/15411 discloses a method where a round liner is deformed into a geometrical shape having a substantially smaller overall dimension, inserting the deformed liner into the existing tubing and reforming the liner to a round shape.

Finally, the liner is expanded on to the internal surface of the existing tubing and afterwards crosslinked.

Reference is further made to GB 2272038, which is also incorporated herein by reference. The GB 2272038 discloses a method of lining a pipeline with a tubular liner made from crosslinked polyethylene by axially twisting the liner, keeping the liner in its axially twisted configuration while inserting the liner into the pipline and finally untwisting the liner and thereby expanding the liner into contact with the inner surface of the pipeline.

Further methods include those known as "swagelining" and "rolldown" where the outside diameter of the liners is temporarily reduced so they can be easily pulled into the tubing before recovering the diameter to the bore of the tubing. These methods ensure, that the liner has the desired tight fit inside the tubing.

All of the above mentioned methods are suitable for producing the oil well tubings of the present invention. Generally, it is possible to insert the polyethylene liner into the tubing in a crosslinked or non crosslinked state. If a liner of non crosslinked polyethylene is inserted, it must then be crosslinked by suitable means, i.e. exposure to radiation or exposure to water or steam at elevated temperatures.

According to a preferred embodiment, the liners which are used in the present invention have a thickness of 0.5-10 mm. Below 0.5 mm the lifetime of the liner and consequently the durability of the tubing itself are not sufficiently increased. For thicknesses up to and above 10 mm all requirements as to durability and corrosion resistance are fulfilled, however, above 10 mm thickness the capacity of the tubing to transport fluid is already unfavourably reduced.

More preferred values for the thickness of the liners are 2-8 mm and even more preferred is a thickness of the liner of 3-6 mm.

Generally, the density of the used polyethylene is not very critical. It is however preferred to use a polyethylene having a density of at least 920 kg/m$^3$. An upper limit is typically 964 kg/m$^3$ (ethylene homopolymer). Polyethylene with density below 920 kg/m$^3$ is considered by the applicants as too soft for the intended application.

Accordingly, it is still more preferred that the crosslinked polyethylene is a crosslinked high density polyethylene (HDPE) having a density of 940-964 kg/m$^3$. According to a preferred embodiment of the present invention the crosslinked polyethylene has a crosslinking degree of 20-90%.

Generally, it is preferred that the used crosslinked polyethylene has a crosslinking degree of at least 20% in order to make certain that the liner fulfils the requirements regarding abrasion resistance and maintaining the mechanical properties at higher temperatures. Crosslinking degrees above 90% may be employed, but it has been found that degrees from 20 to 90% are usually sufficient. Preferred are crosslinking degrees of 30-80%, more preferred 40-80%, even more preferred 50-80%. A particular preferred crosslinking degree is about 65%.

Crosslinked polyethylene can be produced by one of three methods explained below:

1. Chemical Crosslinking (Engels/Azo Process)
2. Irradiation
3. Silane Grafting and Hydrolysis 1. Chemical Crosslinking The Engels process uses polyethylene containing a high concentration of organic peroxide. The polyethylene is extruded and held at elevated temperatures for a period of time after extrusion inside long pressure tubes. During this time the peroxide decomposes to free radicals which react with the polymer to form carbon-carbon bonds between the polyethylene chains.

The high capital cost of the extrusion equipment necessary for this process has mitigated against its widespread introduction since the 1950's and 60's when it was the first crosslinked polyethylene to be commercially exploited.

The crosslinked structure created (direct carbon to carbon crosslinks between PE. chains) is two-dimensional/planar in character and not as ultimately effective as the Silane grafted structure. It is also restricted to extrusion processes.

The Azo process is similar in nature to the Engels process, using an Azo compound rather than a peroxide. The Azo compound decomposes at very high temperatures, normally in downstream catenary tubes, once again to form free radicals to crosslink the polyethylene chains together.

2. Irradiation

Moulded polyethylene articles or extrusions are passed through an accelerated electron beam (Beta or Gamma radiation) which forms free radicals in the polymer and links directly polyethylene chain to chain. The structure created is planar as in the peroxide (chemical) crosslinking system. The polyethylene used contains "co-agents", which adds to the raw material costs.

3. Silane Grafting and Hydrolysis

In this process a crosslinkable graft copolymer is formed by grafting short side chains of organosilanes on to the main polyethylene structure. The resulting polymer is still thermoplastic. The grafting process is normally carried out in a high shear extruder. This is normally carried out on a Ko Kneader or twin co-rotating screw extruder, using the extruder as a chemical reactor. The moulder or extruder then blends this graft copolymer with a catalyst masterbatch and extrudes the still thermoplastic material to form the finished product.

At this stage, e.g. pipe extrusion, injection moulding, no or only a very low level of crosslinking occurs. Crosslinking is achieved later by reacting the pipes with moisture, either from hot water baths or a steam chamber.

The water molecules diffuse into the polyethylene and a chemical reaction takes place between water and the end groups of the organosilane side chains. This reaction forms siloxane crosslinks which directly join the polyethylene chains. The catalyst present accelerates the rate of crosslinking and enables economically viable crosslinking times to be achieved. Importantly, the end of any silane side chain is capable of forming crosslinks with three different adjacent silane side chains. This gives a bunch-like crosslink structure having a three dimensional trellis type form. This final crosslink network is usually more resistant to heat and pressure changes than the planar type structures given by the peroxide of irradiation routes.

Preferably, for the present invention the used crosslinked polyethylene is produced by silane grafting and hydrolysis.

According to a preferred embodiment of the present invention, the crosslinked polyethylene has an MFR (190° C., 2.16° kg), determined according to ISO 1133, before crosslinking of 0.1-4 g/10 min.

The polymer liners which are used in the present invention are according to a preferred embodiment comprised of more than one layers, where at least the inner layer comprises crosslinked polyethylene.

According to an alternative embodiment, the polymer liners are single layered.

According to a preferred embodiment of the present invention the well tubings 12 with crosslinked polyethylene liners are used in rod pumping systems where a sucker rod 16 is disposed in each of the well tubings 12.

As already outlined above, a particularly preferred embodiment of the present invention is a well tubing 12, which is an oil well tubing.

According to a still further preferred embodiment of the present invention, the couplings 18, which are used to connect individual rod sections, e.g. as indicated by 16*a*, 16*b*, of which the sucker rods 16 are comprised, have a surface roughness of ≤2.8 μm.

For a basic embodiment of the present invention the material properties of the sucker rod sections and the sucker rod couplings are irrelevant, i.e. a remarkably increased lifetime is already observed with the use of the crosslinked polyethylene liners alone, even when conventional sucker rods with conventional carbon steel sucker rod couplings are still employed.

However, this positive effect can be still further improved, when specific rod couplings 18 are used which have a very smooth surface roughness. The smoothness of the surface is expressed as a surface roughness $R_a$ of ≤2.8 μm. More preferably the surface roughness $R_a$ is ≤1.6 μm, even more preferably the surface roughness $R_a$ is ≤1.0 μm, still more preferably the surface roughness $R_a$ is ≤0.6 μm and most preferably the surface roughness $R_a$ is ≤0.2 μm. A particularly preferred value for the surface roughness $R_a$ is about 0.1 μm.

According to a still further preferred embodiment, the couplings 18 have a surface hardness $HV_{200}$ of ≥300, more preferably a surface hardness $HV_{200}$ of ≥450, even more preferably a surface hardness $HV_{200}$ of ≥595.

A high surface hardness ensures, that an already smooth surface remains smooth for a long period of time while the coupling is being used.

A combination of a very smooth surface (surface roughness of ≤2.8 μm) together with a surface hardness in the specified range has proven to show the best results. According to a preferred embodiment of the present invention the rod couplings 18 comprise a wear layer on an outer surface of the coupling 18, where the wear layer comprises spray metal which is heat fused to the outer surface.

Spray metal is applied onto a substrate by thermal spray coating. Thermal spray coating involves the use of a torch to heat a material, in powder or wire form, to a molten or near-molten state, and the use of a gas to propel the material to the target substrate, creating a completely new surface. The coating material may be a single element, alloy or compound with unique physical properties that are, in most cases, achievable only through the thermal spray process.

Thermal spray coatings are a highly cost-effective and straight-forward method for adding superior properties and performance qualities to a given engineering surface. The variety of products and coatings that can be enhanced by thermal spray are virtually limitless. The coatings are usually metallic, ceramic, carbides, or a combination of these materials to meet a range of physical criteria.

As a family of related technologies, each thermal spray process brings distinct advantages. This provides a high degree of flexibility to meet a wide array of application and production requirements. These processes include:

Atmospheric Plasma Spray, Champro® Controlled Atmosphere Plasma Spray, HVOF (High Velocity Oxy-Fuel) Spray, using either gas or liquid as the combustion fuel, Combustion Powder Thermospray®, Combustion Wire Spray and Electric Arc Wire Spray.

Due to the spray metal layer the couplings 18 are very corrosion resistant and show hardly any general corrosion (general corrosion rate in oilfield fluids <1 μm/year).

Generally, the corrosion resistance, measured as pitting depth of couplings (including couplings with and without spray metal layer) is preferably ≤0.025 mm at a temperature of 0° C., preferably ≤0.025 mm at 10° C., more preferably ≤0.025 mm at 20° C. and still more preferably ≤0.025 mm at 30° C. and most preferably ≤0.025 mm at a temperature of >30° C., e.g. at 50° C. This corrosion test is carried out according to ASTM G48-03 (according to Method C for Nickel-base and Chromium-bearing alloys and according to Method E for Stainless Steels).

According to a particularly preferred embodiment of the invention rod couplings 18 are used which have an outer wear layer comprising spray metal and which couplings have a surface roughness $R_a$ is ≤0.2 μm, preferably about 0.1 μm, and which have a surface hardness $HV_{200}$≥595.

The composition of the spray metal coating suitable for sucker rod couplings is defined in a specification from the American Petroleum Institute (API)

("Specification for Sucker Rods", API Specification 11B, Twenty-Sixth Edition, Jan. 1, 1998; page 6, table 7)

Accordingly, it is preferred that the wear layer comprises 0.50-1.00 wt % carbon, 3.50-5.50 wt % silicon, 12.00-18.00 wt % chromium, 2.50-4.5 wt % boron, 3.00-5.5 wt % iron and the remainder being nickel.

Small amounts of phosphorus (≤0.02 wt %), sulfur (≤0.02 wt %), cobalt (≤0.10 wt %), titanium (≤0.05 wt %), aluminum (≤0.05 wt %) and zirconium (≤0.05 wt %) may also be present.

A very specific embodiment of the present invention is a rod pumping system, comprising one or more well tubings 12 where each tubing 12 comprises a plurality of tubing sections, e.g 12*a*, 12*b*, each having a bore and an inside diameter, wherein at least part of the tubing sections has polymer liners 14 disposed within said bore of said tubing section, wherein the polymer liners 14 are comprised of crosslinked polyethylene and where sucker rods 16 are disposed in each of the well tubings 12 and where each of the sucker rods 16 comprises a plurality of rod sections, e.g 16*a*, 16*b*, individual rod sections being connected to each other by couplings 18 where the couplings 18 have a surface corrosion resistance of ≤0.025 mm at 0° C., determined according to ASTM G 48-03, Method C or E. A further very specific embodiment of the present invention is a rod pumping system, comprising one or more well tubings 12 where each tubing 12 comprises a plurality of tubing sections, e.g 12*a*, 12*b*, each having a bore and an inside diameter, wherein at least part of the tubing sections has polymer liners 14 disposed within said bore of said tubing section, wherein the polymer liners 14 are comprised of crosslinked polyethylene and where sucker rods 16 are disposed in each of the well tubings 12 and where each of the sucker rods 16 comprises a plurality of rod sections, e.g

16*a*, 16*b*, individual rod sections being connected to each other by couplings 18 where the couplings have a surface roughness $R_a$ of ≤2.8 μm.

EXAMPLES

Measurement Methods

MFR, Melt Flow Rate

The melt flow rate was measured according to ISO 1133 with a load of 2.16 kg at 190° C. for polyethylene.

Density

Density was determined according to ISO 1183.

Crosslinking Degree

The crosslinking degree of polyethylene was determined according to ISO 10147.

Hardness

Hardness of spray metal was determined as Vickers Hardness $HV_{200}$ according to ASTM E 384. Hardness of carbon steel was determined as Rockwell Hardness HRA according to DIN EN ISO 6508

Surface Roughness:

Surface Roughness was determined as Roughness $R_a$ according to ISO 4288 and ISO 4287.

Corrosion Resistance

Corrosion resistance was determined according to ASTM G48-03, method C. (method E should be used for stainless steel couplings)

Wear Rate

The wear rates of sucker rod couplings on the polyethylene materials which are used according to the present invention were determined with the following experimental setup and procedure.

The test apparatus simulates the reciprocating movement of the sucker rod coupling against the polymer lined tubing string under realistic conditions. For shortening the experimental time, the movement has been changed from reciprocating to rotation and to higher rotation speeds.

For simulating the movement (rotation) a box column drill with variable rotation speed is used. The drilling machine is installed in a basin which is filled with the testing fluid. The polymer test samples are fixed on a stainless steel plate which is in connection with the power drill. Due to immiscibility of water and oil, a circulating pump is used for mixing the fluid during the whole testing procedure. Because of the necessity to simulate real conditions a constant temperature (50° C.) of the fluid is maintained with a heating element. In order to avoid evaporation of the fluid it is necessary to cover the basin with caps, so that loss of fluid is avoided and in order to keep a constant ratio between water and oil.

The polymer sample plates are cut via jigsaw into round layouts. These round plates are fixed with two metal rings (inner and outer ring) to the underside of the steel plate. Two couplings are placed at the bottom of the box column drill and are securely fixed so they cannot loosen during testing operation. The height of the drilling machine is adjusted such that the polymer plate touches both couplings. The lever of the drilling machine is loaded with the selected lead weight. The basin is filled with the raw oil/water mixture and the circulating pump is started to mix and distribute the medium. The heating element is activated and when the preset temperature is reached and the polymer plate and couplings are immersed in a homogeneous oil/water mixture the box column drill is started.

In field operations the stroke rate of a sucker rod pump is approximately 8 times per minute (depending upon the inflow rate of the medium to pump). That means, that the coupling passes the same location of the tubing 16 times per minute. The box column drill is set to a rotation speed of 345 rpm and a running time of 5 days and 21 hours. Thus, this testing procedure simulates 127 days in field. For testing the counterparts polymer/unalloyed steel coupling a weight of 65 kg is loaded (separated on two couplings or centralizer) which correlates to a well deviation of 7° in field. In case of polymer/spray metal couplings the load is doubled.

A fluid temperature of 50° C. is kept and controlled by a heating unit to simulate equivalent conditions as found in existing oil wells.

The following table shows the ratio of ingredients of the medium which is containing water, oil and salt (sodium chloride).

| Medium | Volume [l] | Volume [%] |
|---|---|---|
| Water | 290 | 94.7 |
| Crude Oil | 12.75 | 4.2 |
| Salt | 3.5 | 1.1(11000ppm) |
| Total | 306.25 | 100 |

After the wear test is finished, the surface of the polymer plate is analysed with an InfiniteFocus 2.0.1®0 optical 3D measurement device for analysing surface topography.

InfiniteFocus 2.0.1® offers different measurement capabilities. With an automatic calculation of a reference plane from 3D points and by the use of volume analysis (calculates the volume of voids and protrusions) the area wear rate [$mm^3$ per 127 days] of the polymer plates was calculated.

Polymer Properties

PE1 is a high density polyethylene grafted with vinyltrimethoxysilane (VTMS) containing 2 wt % VTMS.

Density of PE1 is 948 $kg/m^3$. MFR=2 g/10 min (2.16 kg, 190° C.).

Crosslinking Masterbatch is a blend of 1.8 wt % dioctyl tin dilaurate, 0.4 wt % Irganox 1010 and HDPE (MFR=4 g/10 min (2.16 kg, 190° C.))

Production of Polyethylene Plates

Plates having a thickness of 5 mm were produced from a blend of 95 wt % PE1 with 5 wt % Crosslinking Masterbatch.

The following apparatus was used:

Kuhne Extruder K60-30D, flat die with 860 mm breadth

Kuhne Kalander GA 3/900: 3 rolls with 300 mm diameter and length of 900 mm each

Kuhne Take-Off BAW Z/1-900

Output from the extruder was 100 kg/h, melt temperature 223° C., melt pressure before the die 61 bar and take-off speed was 0.78 m/min.

The plates were cut into individual pieces with dimensions of 320×320×5 mm.

For crosslinking, plates were stored for 16 h in water having a temperature of 95° C.

Measured crosslinking degree: 64.7%

Plates from crosslinked polyethylene were used for example 1. The plates for example 2 were not crosslinked.

Couplings

The following couplings were used for the examples:

1. Spray Metal Couplings (SMC):

were commercially obtained from Tenaris.

Couplings having a surface roughness $R_a$ of 0.1 μm, 0.4 μm, 0.8 μm and 1.6 μm were used. The used Spray metal couplings have a conventional carbon steel substrate onto which a layer of spray metal is applied. The layer thickness of spray metal was 300 μm on the used couplings.

Surface Roughness $R_a$ of couplings was determined according to ISO 4288 and ISO 4287 on the couplings as commercially obtained.

Surface Hardness of the used couplings was determined as Vickers Hardness $HV_{200}$ according to ASTM E 384. The used couplings had a surface hardness $HV_{200}$ of 600.

The corrosion resistance of the spray metal couplings was tested according to ASTM G 48-03, Method C. The pitting depth, which was observed at the test temperatures of 0° C., 10° C., 20° C. and 30° C. was below 0.025 mm.

2. Carbon Steel Couplings were commercially obtained from Schoeller Bleckmann (SBS).

The surface roughness $R_a$ of the carbon steel coupling was 3 μm. Surface Hardness of the carbon steel couplings was HRA 60.

Results

| Spray metal coupling Roughness $R_a$[μm] | Example 1 crosslinked Wear rate [$mm^3$/127d] | Example 2 Not crosslinked Wear rate [$mm^3$/127d] |
|---|---|---|
| 0.1 | 0.2 | 0.3 |
| 0.4 | 0.3 | 0.5 |
| 0.8 | 0.5 | 0.8 |
| 1.6 | 0.8 | 1.0 |
| Carbon steel coupling $R_a$ = 3.0 μm | 1.4 | 5.9 |

We claim:

1. Rod pumping system comprising, at least one well tubing and sucker rods disposed in each of the well tubings, wherein each well tubing comprises a plurality of tubing sections each having a bore and an inside diameter, wherein at least one of the tubing sections has a polymer liner disposed and tight fitted within said bore of said tubing section, wherein said polymer liner is comprised of more than one layer, where at least the inner layer consists essentially of a crosslinked polyethylene produced by silane grafting and hydrolysis, having a crosslinked degree of 20-90 which has a non-planar type cross linked structure, wherein said polyethylene is an ethylene homopolymer having an MFR (190° C., 2.16° kg), determined according to ISO 1133, before crosslinking of 0.1-4 g/10 min., said well tubing is an oil well tubing and said rod pumping system is a subsurface sucker rod pump.

2. Rod pumping system according to claim 1, wherein each of the sucker rods comprises a plurality of rod sections, individual rod sections being connected to each other by couplings, wherein the couplings have a surface corrosion resistance of ≤0.025 mm at 0° C., determined according to ASTM G 48-03, Method C or E.

3. Rod pumping system according to claim 2, wherein the couplings have a surface hardness $HV_{200}$ of ≥300.

4. Rod pumping system according to claim 2, wherein the couplings comprise a wear layer on an outer surface of the coupling, where the wear layer comprises spray metal which is heat fused to the outer surface.

5. Rod pumping system according to claim 4, wherein the wear layer comprises 0.50-1.00 wt % carbon, 3.50-5.50 wt % silicon, 12.00-18.00 wt % chromium, 2.50-4.5 wt % boron, 3.00-5.5 wt % iron and the remainder being nickel.

6. Rod pumping system according to claim 1, wherein each of the sucker rods comprises a plurality of rod sections, individual rod sections being connected to each other by couplings, wherein the couplings have a surface roughness $R_a$ of ≤2.8 μm.

7. Rod pumping system, comprising at least one well tubing where each tubing comprises a plurality of tubing sections each having a bore and an inside diameter, said well tubing is an oil well tubing and said rod pumping system is a subsurface sucker rod pump, wherein at least one of the tubing sections has a polymer liner disposed and tight fitted within said bore of said tubing section, wherein the polymer liner is comprised of more than one layer, where at least the inner layer consists essentially of a crosslinked polyethylene produced by silane grafting and hydrolysis, having a crosslinked degree of 20-90 which has a non-planar type cross linked structure, wherein said polyethylene is an ethylene homopolymer having an MFR (190° C., 2.16° kg), determined according to ISO 1133, before crosslinking of 0.1-4 q/10 min., and where sucker rods are disposed in each of the well tubings and where each of the sucker rods comprises a plurality of rod sections, individual rod sections being connected to each other by couplings where the couplings have a surface corrosion resistance of ≤0.025 mm at 0° C, determined according to ASTM G 48-03, Method C or E.

8. Rod pumping system, comprising at least one well tubing suitable for a subsurface sucker rod pump, where each tubing comprises a plurality of tubing sections each having a bore and an inside diameter, wherein at least one of the tubing sections has a polymer liner disposed and tight fitted within said bore of said tubing section, wherein the polymer liner is comprised of more than one layer, where at least the inner layer consists essentially of a crosslinked polyethylene produced by silane grafting and hydrolysis, having a crosslinked degree of 20-90 which has a non-planar type cross linked structure, wherein said polyethylene is an ethylene homopolymer having an MFR (19° C., 2.16° kg), determined according to ISO 1133, before crosslinking of 0.1-4 g/10 min., and where sucker rods are disposed in each of the well tubings and where each of the sucker rods comprises a plurality of rod sections, individual rod sections being connected to each other by couplings where the couplings have a surface roughness $R_a$ of ≤2.8 μm.

9. A subsurface sucker rod pumping system including a well tubing with a coupling and sucker rods in the well tubing coupled together by a coupling comprising, at least one well tubing and coupling, each well tubing comprising a plurality of tubing sections each having a bore and an inside diameter, wherein at least one of the tubing sections has a polymer liner disposed and tight fitted within said bore of said tubing section, the improvement comprising wherein said polymer liner is comprised of more than one layer, where at least the inner layer consists essentially of a crosslinked polyethylene produced by silane grafting and hydrolysis, having a crosslinked degree of 20-90 which has a non-planar type cross linked structure, wherein said polyethylene is an ethylene homopolymer having an MFR (190° C., 2.16° kg), determined according to ISO 1133, before crosslinking of 0.1-4 g/10 min., a wear layer on an outer surface of the sucker rod coupling, a surface corrosion resistance of ≤0.025 mm at 0° C, determined according to ASTM G 48-03, Method C or E, a surface roughness $R_a$ of ≤1.0 μm, a surface hardness $HV_{200}$ of ≥300, and wear rate of 0.2 to 1.0 $mm^3$/127d.

10. Well tubing according to claim 1, wherein the polymer liner has a thickness of 0.5-10 mm.

11. Well tubing according to claim 1, wherein the crosslinked polyethylene has a density of at least 920 $kg/m^3$.

12. Well tubing according to claim 11, wherein the crosslinked polyethylene is a crosslinked high density polyethylene (HDPE) having a density of 940-964 $kg/m^3$.

13. Well tubing according to claim 1, wherein the tubing is an oil well tubing.

14. Well tubing according to claim 1 wherein the crosslinked polyethylene has a crosslinking degree of about 65%.

15. Well tubing according to claim 1 wherein the crosslinked polyethylene has a crosslinking degree of about 20-50%.

* * * * *